US006923246B2

(12) United States Patent
Tsuchiya et al.

(10) Patent No.: US 6,923,246 B2
(45) Date of Patent: Aug. 2, 2005

(54) BILLET, HORIZONTAL CONTINUOUS CASTING PROCESS, AND THIXOCASTING PROCESS

(75) Inventors: Masayuki Tsuchiya, Wako (JP); Hiroaki Ueno, Wako (JP); Yasushi Fujinaga, Kobe (JP); Chiaki Ushigome, Kobe (JP); Susumu Nishikawa, Kobe (JP)

(73) Assignees: Honda Giken Kogyo Kabushiki Kaisha, Tokyo (JP); Kogi Corporation, Hyogo (JP)

( * ) Notice: Subject to any disclaimer, the term of this patent is extended or adjusted under 35 U.S.C. 154(b) by 65 days.

(21) Appl. No.: 10/401,044

(22) Filed: Mar. 28, 2003

(65) Prior Publication Data

US 2003/0222123 A1 Dec. 4, 2003

(30) Foreign Application Priority Data

Mar. 29, 2002 (JP) ..... 2002-096608
Jun. 28, 2002 (JP) ..... 2002-189229

(51) Int. Cl.[7] ..... B22D 11/00

(52) U.S. Cl. ..... 164/490; 164/440; 148/579

(58) Field of Search ..... 164/490, 440, 164/438, 439; 148/579

(56) References Cited

U.S. PATENT DOCUMENTS 3,731,728 A * 5/1973 Webbere et al. ..... 164/440
4,653,570 A * 3/1987 Stonecliffe et al. ..... 164/440
4,977,037 A * 12/1990 Ward et al. ..... 428/577
6,136,101 A * 10/2000 Sugawara et al. ..... 148/321

* cited by examiner

*Primary Examiner*—Kiley S. Stoner
*Assistant Examiner*—I.-H. Lin
(74) *Attorney, Agent, or Firm*—Arent Fox, PLLC

(57) ABSTRACT

A billet for a thixocasting process and a thixocasting process using the billet allows casting using a thixocasting process to be realized at low production cost without permeation of an oxide film to the inside of the billet in injection molding. In a billet used for a thixocasting process continuously cast by intermittently drawing out, the interval of the oscillation marks is 10 mm or less and the maximum tilt angle of the oscillation marks relative to a cross section which is at a right angle to the drawing out direction is 45° or less.

8 Claims, 5 Drawing Sheets

BILLET, HORIZONTAL CONTINUOUS CASTING PROCESS, AND THIXOCASTING PROCESS

BACKGROUND OF THE INVENTION

1. Field of the Invention

The present invention relates to a billet used in precast forming of metal. The present invention also relates to a horizontal continuous casting process which cools molten metal continuously and horizontally draws out a solidified cast piece, and in particular, relates to a horizontal continuous casting process which is effective in the case of using hypo-eutectic cast iron. The present invention relates to a thixocasting process which performs pressure casting using the above billet and in particular, relates to a thixocasting process which prevents an oxide film formed on the surface of a billet from entering into the billet at a low production cost 2. Description of the Related Art Continuous casting processes have been widely used as processes for mass-producing uniform and high quality metal material at low cost. The continuous casting processes include a vertical type process in which a cast piece is drawn out downwardly and a horizontal type process in which a cast piece is drawn out horizontally, and the horizontal type process is employed more often than the vertical type process in view of lower equipment cost. In the horizontal type continuous casting process, generally, molten metal stored in a tundish is supplied into a mold which is horizontally installed and is simultaneously cooled, and a cast piece in which at least the circumference portion is solidified in the mold is thereby formed, and then, the cast piece discharged from the mold is continuously and horizontally drawn out by drawing out equipment.

The above mold used in the horizontal continuous casting is of a cylindrical shape or a prism shape and is provided with a cooling jacket at the circumference thereof. Therefore, the mold acts so that a solidified shell grows by continuously supplying molten metal into the inside and by cooling, and a forming position of the solidified shell, that is, a solidifying initiation position of molten metal is stabilized. Materials of the mold generally differ between the case in which the cast is cast iron and in the case in which it is steel for the following reasons.

Since the cast iron has relatively low toughness, cracks, which are a type of surface defect which is easily generated, and breakouts or fractures of cast pieces which are easily generated, occur when friction between the cast piece and inner wall surface of a mold is high, and therefore, graphite having superior lubricity is used therewith. Here, the term "breakout" refers to a deficiency in which cracks are generated on the surface of a cast piece discharged from a mold and the cracks reach the interior non-solidified portion by extending, and molten metal leaks or erupts, and the term "fracture" refers to a state in which a cast piece is cut off after perfectly solidifying the inside. When a breakout or fracture is generated, the drawing out of the cast piece must be stopped. Since the cast iron has relatively low solidifying contraction, it is difficult to generate a gap between the cast iron and mold by the solidifying contraction, and therefore, a solidified shell can be efficiently grown by cooling when a long mold made of graphite is provided. In continuous casting of the cast iron, a solidified shell may be grown by carrying out secondary cooling in which air is blown or water mist is sprayed just after discharging from the mold.

In contrast, in the case in which the cast is of steel, a mold made of graphite is easily damaged by molten metal. When the damage by molten metal occurs, surface quality of the cast is deteriorated, and C (carbon) of the mold damaged by molten metal permeates into the steel and the amount of C in the cast piece is thereby increased. Therefore, a mold made of a Cu alloy is employed. Since the steel has relatively large solidifying contraction, it is easy to generate a gap between the steel and mold by the solidifying contraction, and in particular, in horizontal continuous casting, generation of the gap shifts to the upper side of the mold due to gravity. According to the generation of the gap, coolability of the cast piece to be cooled by contacting the mold is significantly decreased. Thus, it is proposed that a solidified shell of a cast piece be grown by supplying molten metal into a fixed first mold, and then the cast piece be passed to a second mold which can move in a radial direction, and the gap is eliminated by pressing the cast piece by the second mold. This second mold is well known, for example, from Japanese Utility Unexamined Publication No. 5-93641. In horizontal continuous casting combined such a first mold and a second mold, the first mold has a length of 200 mm or more. Additionally, the cast piece is intermittently drawn out generally in strokes of 40 to 50 mm.

The reasons for intermittently drawing out the cast piece are as follows. The mold has a temperature gradient in which the temperature gradually decreases from the tundish side toward the drawing out direction. When the cast piece is continuously drawn out, the temperature of the molten metal passes a solidifying initiation temperature according to the temperature gradient; however, in this case, the solidification interface is easily disturbed by uneven temperature, or the like. In contrast, when the cast piece is intermittently drawn out, the temperature of the molten metal passes a solidifying initiation temperature at a cooling rate above the temperature gradient of the mold, and the cast piece is solidified rapidly. Therefore, the solidification interface is stably formed, and a sound cast piece can be thereby cast.

Incidentally, a continuous casting material made of a hypo-eutectic cast iron has recently attracted attention, as a good machinability cast iron or material for a half-melted molding, having a high Young's modulus or high strength. However, the growth of a solidified shell is slow since the hypo-eutectic cast iron has a wider temperature range of solid-liquid phase coexistence than that of a cast iron or steel, and therefore, cracks are easily generated in the solidified shell, and moreover, a half-solidified structure having decreased flowability frequently prevents molten metal from being supplied. In addition, the cast piece has low toughness and cracks are easily generated in the solidified shell, since the solidified shell is easily cooled. Furthermore, because solidification contraction is relatively large, a gap easily forms between the cast piece and the mold, and efficient growth of the solidified shell cannot be as desired. From these reasons, breakouts or fractures easily occur and it is difficult to carry out continuous casting, even if the above mobile second mold is used, and therefore, development of an effective continuous casting process has been desired.

In addition, a billet as a material for casting using a thixocasting process forms an iron oxide film on the surface thereof when it is heated in a half-melted state in the air. This oxide film contributes to the form maintaining property of the billet in a half-melted state; however, when the billet is transformed in heating or in inserting the billet into a sleeve, the oxide film often permeates the inside of the billet as foreign material in the subsequent injection molding, and consequently, a reduction of the product strength occurs.

In order to overcome the above deficiencies, so far, for example, as described in Japanese Patent Unexamined Publication No. 5-42352, a surface decarbonization film layer was formed by previously decarburizing the surface of billet and a property of the billet in a half-melted state was improved, and desired product strength was thereby obtained.

However, it is necessary to carry out a process in which heating at 700 to 1000° C. for over 20 minutes in air or in which heating at 700 to 1200° C. for over 10 minutes in a reducing atmosphere including water in order to form the surface decarbonization film layer, and a desired low production cost could not be realized. For this reason, development of a billet for thixocasting which can prevent an oxide film from permeating to the inside of the billet in injection molding at low cost, and a thixocasting process which is carried out by pressure-casting using the billet, have been desired.

SUMMARY OF THE INVENTION

It is an object of the present invention to provide a billet for thixocasting which can carry out casting using a thixocasting process without permeation of an oxide film into the inside of the billet in injection molding at low cost. In addition, it is an object of the present invention to provide a horizontal continuous casting process which can stably carry out a horizontal continuous casting of hypo-eutectic cast iron without causing breakouts or fractures. Furthermore, it is an object of the present invention to provide a thixocasting process in which pressure-casting is carried out using the above billet.

A billet of the present invention is used for a thixocasting process which is continuously cast by intermittently being drawn out, and it is characterized in that the interval of oscillation marks is set to be 10 mm or less and the maximum tilt angle of the oscillation mark against a cross section which is at a right angle to a drawing out direction is set to be 45° or less.

That is, in the present invention it is assumed that, in order to avoid an oxide film permeating to the inside of the billet in injection-molding at low production cost by form maintaining property of the billet in heating at a high level, an oxide film formed on the surface of the billet in a continuous casting process is utilized to advantage, instead of carrying out expensive heating treatment separately as conventionally. Specifically, in the present invention, a billet in which the interval of oscillation marks formed on a continuous casting material by the intermittently drawing out is set to be 10 mm or less and the maximum tilt angle of the oscillation mark against a cross section which is at a right angle to a drawing out direction is set to be 45° or less is used, and casting using a thixocasting process can be thereby realized.

Here, the term "oscillation mark" refers to a striped pattern formed on the casting surface by intermittently drawing out in continuous casting, in which discontinuous interface formed by transferring and stopping of solidified interface due to drawing out appears at a pitch which depends on the drawing out stroke, and it corresponds to contraction caused by solidification of the molten metal or cold shuts in general cast products.

The present inventors have found that when the billet is continuously cast by intermittently drawing out, the interval of oscillation marks formed on a continuous casting material and the maximum tilt angle of the oscillation marks against a cross section which is at a right angle to a drawing out direction (hereinafter referred to as "maximum tilt angle") affects the permeation of an oxide film to the inside of the billet in injection molding, and they realized prevention of the oxide film permeating to the inside of the billet in injection-molding at low production cost by properly selecting the above interval and maximum tilt angle. In the following, reasons why proper selection of the above interval and the maximum tilt angle can prevent an oxide film from permeating to the inside of the billet are described.

In the case in which a continuous casting process is carried out by intermittently drawing out a billet, oscillation marks are formed on the surface of the billet, and minute unevenness occurs thereby on the surface. Furthermore, an oxide film is formed along the unevenness in the continuous casting process and heating of the billet. This unevenness functions as a rib for reinforcing against stress which impinges in a radial direction so as to increase form maintaining property, and permeating of the oxide film to the inside of the billet which is caused by deforming of the billet in injection-molding can be thereby prevented. Therefore, as the interval of the oscillation marks is decreased, the above effect is increased, and as the result, form maintaining property is improved.

In addition, in the case in which a continuous casting process is carried out by intermittently drawing out a billet using horizontal continuous casting equipment, a temperature difference easily occurs between the top side and the bottom side of the billet. When the temperature difference is small, an oscillation mark is formed nearly perpendicularly, that is, in a direction which is at a right angle to the drawing out direction. In contrast, when the temperature difference is large, the oscillation mark is tilted toward the drawing out direction since the temperature of the top side is easily higher than that of the bottom side. The reinforcing effect against stress which acts in the radial direction increases as tilt of the oscillation mark is brought close to the perpendicular direction, that is, a direction which is at a right angle to a drawing out direction, and consequently, form maintaining property of the billet is improved.

In addition, the interval of the oscillation mark can be controlled by properly selecting one drawing out stroke of an intermittent drawing out process in a continuous casting. In addition, the maximum tilt angle of the oscillation mark can be controlled, for example, by properly selecting the temperature difference between the top side and the bottom side of the billet as described above, in the case of a horizontal continuous casting process, and specifically, by suitably selecting a mold length of a first mold in the horizontal continuous casting equipment for producing the billet and a drawing out stopping time in intermittent drawing out.

Therefore, in the present invention, a desired billet is previously produced by suitably selecting the interval at which the oscillation marks are formed on the surface of the billet and the maximum tilt angle, and as the result, casting using a thixocasting process can be realized at low production cost without permeation of an oxide film to the inside of the billet in injection molding.

In the present invention, it is preferable that the above maximum tilt angle be set to be 15° or less. According to the above, since the billet is perfectly prevented from deforming in injection molding, the oxide film can be advantageously prevented from permeating to the inside of the billet, and moreover, the billet can be advantageously prevented from hooking or failing to catch in feeding the billet by a robot or in inserting into a sleeve.

Additionally, a horizontal continuous casting process for a hypo-eutectic cast iron of the present invention comprises:

inserting molten metal into a first mold, cooling the molten mold to form a cast piece while passing to a second mold which can move so as to press the cast piece, and intermittently drawing out the cast piece discharged from the second mold at a specific drawing out stroke, and is characterized in that the length of an inner wall in the first mold is set to be 100 to 180 mm and the drawing out stroke is set to be 5 to 10 mm.

In the present invention, a solidified shell is formed in the first mold, and the solidified shell is grown in the second mold. The present inventors carried out horizontal continuous casting tests of a hypo-eutectic cast iron using a first mold made of graphite and a movable second mold made of a Cu alloy, and as a result, according to estimation by positions at which marks on the cast piece were generated, a solidifying initiation position was a position of about 20 mm from a side end of the tundish of the first mold, and an initiation position in which gap forms between the cast piece and the mold by solidifying contraction was a position of about 100 mm from the solidifying initiation position (about 120 mm from a side end of the tundish of the first mold). In addition, breakout did not occur, even if secondary cooling by the second mold was started at about 20 mm before gap occurs (about 100 mm from a side end of the tundish of the first mold). On the other hand, since cooling of a top side of the cast piece is delayed when gap is generated, the oscillation mark easily tilts, as described below, and cracks easily occur at the top side. A maximum length of the first mold in which the cracks are not generated on the top side of the cast piece was about 180 mm. This behavior did not correlate with a diameter of the cast piece (inner diameter of each mold), and it was nearly constant.

Therefore, a length of an inner wall of the first mold was set to be 100 to 180 mm which was shorter than a conventional length. Here, in the case in which temperature of molten metal cannot be high-precisely controlled, there are cases in which the temperature of the molten metal increases when molten metal is replenished. In these cases, a solidifying initiation position shifts about 30 mm toward a drawing out direction of the first mold. On the other hand, a position where it was difficult for an oscillation mark to tilt was a position which was about 160 mm from a side end of the tundish of the first mold. Therefore, it is preferable that the length of the first mold be 130 to 160 mm.

Additionally, in the second mold, a powerful cooling ability is desired in order to promote growth of the solidified shell. The second mold should be installed at a position which is as near as possible to the first mold, and it is preferable that it be installed at a position in which gap occurs between it and the molds by solidifying contraction when solidification of the cast piece is progressed by some degree. In order to efficiently cool by contacting to the circumference of the cast piece, the second mold is divided at the circumference of the cast piece so that divided parts can move in a radial direction, and it functions so as to press the cast piece by a bias means such as a fluid-pressure cylinder or a spring.

In order to prevent generation of breakouts due to cracks in the solidified shell, a drawing out stroke is set to be 5 to 10 mm, which is shorter than a conventional stroke of 40 to 50 mm, since a hypo-eutectic cast iron has a relatively low toughness, and it is set to be a suitable stopping time. Here, reasons why the stroke is shortened to 5 to 10 mm are as follows. Since the mold has a temperature gradient so that the temperature decreases from the tundish side toward the drawing out direction, temperatures at each position between the strokes are different, and cooling conditions thereof are also different, respectively. A solidifying interface is easily formed unevenly because of the differences of temperatures at each position between the strokes is large if the stroke is long. When the stroke is 10 mm or less, the difference in temperature at each position is small and the solidifying interface is uniform, and a sound cast piece can be thereby produced. However, when it is 5 mm or less, the stopping time must be also shortened, and moreover, since an intermittent operation of drawing out and stopping is frequently carried out, load on a driving system of the drawing out equipment is large, and it is difficult to control the operation.

The first mold in the present invention must have a property in which damage by molten metal is suitably prevented, the molten metal is fed inside without solidifying, and a solidified shell formed at a solidifying initiation position does not fracture even by seizing. As a material for the first mold which satisfies the above, graphite materials which prevent damage by molten metal and which contain silicon carbide, boron carbide, aluminum nitride, etc., in an amount of 30 to 50% by volume, can be employed. In contrast, as a material for the second mold, a Cu alloy is desirable since the powerful cooling ability is desired, as described above. That is, in the present invention, it is preferable that an inner wall of the first mold be made of graphite as a primary component and an inner wall of the second mold be made of a Cu alloy as a primary component.

When the cast piece produced in the preset invention is in a cylindrical shape, it is effective that the diameters thereof, that is, the inner diameters of the first mold and the second mold, be 150 mm or less, and particularly 30 to 100 mm.

Furthermore, according to a thixocasting process of the present invention which pressure-casts the above billet for a thixocasting process, a desired billet is previously produced by suitably selecting the interval of the oscillation marks formed on the surface of the billet and the maximum tilt angle, and as a result, casting using a thixocasting process can be realized at low production cost without permeation of an oxide film to the inside of the billet in injection molding.

In the thixocasting process, it is preferable that the solid concentration of the billet be 30 to 50%. Here, the term "solid concentration" refers to the ratio of the solid phase in a heated billet in a half-melted state when casting using a thixocasting process is carried out. In the present invention, since form maintaining property of the billet is improved by a firm oxide film formed on the surface of the billet, as described above, a half-melted molding can be carried out at lower solid concentration than conventionally, and thin products, that is, products having a thickness of 2 mm or less, can be produced.

DETAILED DESCRIPTION OF THE INVENTION (1) First Embodiment

In the following, a horizontal continuous casting process according to the present invention will be explained in detail in specific embodiments.

Figure 1:
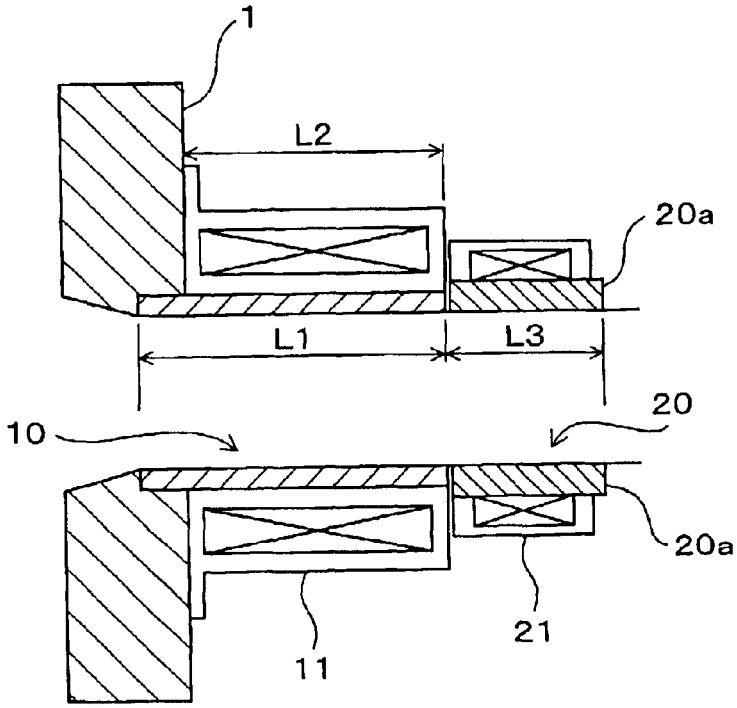
FIG. 1 is a sectional side elevation view of horizontal continuous casting equipment used in Examples of the present invention.

FIG. 1 shows horizontal continuous casting equipment which is continuously provided on a fire-resistant wall 1 of a tundish. In the tundish, molten metal of a hypo-eutectic cast iron which is widely used for a half-melted molding process of iron-carbon material is stored. This horizontal continuous casting equipment comprises a first mold 10 and a second mold 20 in a cylindrical shape, in which axial directions thereof are horizontally installed, and drawing out equipment (which is not shown). The first mold 10 forms a graphite-ceramic complex and connects airtightly to a molten metal exiting port of the fire-resistant wall 1, and a water-cooling jacket 11 is provided in the circumference thereof. The second mold 20 is divided in the circumferential direction and consists of some divided parts 20*a* made of a Cu alloy which are installed in a radial direction so as to be movable, and each divided part 20*a* is pressed toward the inside by a bias member such as a fluid-pressure cylinder or a spring (which is not shown). A water-cooling jacket 21 is provided in the circumference of divided parts 20*a*.

The molten metal is supplied from the inside of the tundish to the inside of the first mold 10 by its own weight and is cooled so as to form a solidified shell, and then a cast piece is formed by solidifying in the inside thereof. The cast piece is passed through the second mold 20, and in this case, each divided part 20*a* is pressed against the cast piece so as to eliminate gap between the cast piece and each divided part 20*a*. The cast piece is drawn out by drawing out equipment installed at a downstream side of the second mold 20, and therefore, a continuous casting process is carried out.

Lengths L1 and L3 of inside walls of a first mold 10 and a second mold 20, length L2 of a water-cooling jacket for the first mold 10, which are shown in FIG. 1, and the inner diameter of the first mold, were set to be values shown in Table 1, and continuous casting equipment for use in Examples 1 to 5 and Comparative Examples 1 to 4 were thereby produced. Here, in continuous casting equipment for Comparative Example 1, the second mold was not provided. Additionally, each hypo-eutectic cast iron having components shown in Table 2 was prepared, and the hypo-eutectic cast iron was maintained in a molten metal state at 1400 to 1420° C. in each tundish to which the above continuous casting equipment for Examples 1 to 5 and Comparative Examples 1 to 4 were connected, respectively. Then, in the continuous casting equipment, a continuous casting test was carried out, which horizontally draws out cast pieces discharged from a second mold having an inner diameter of 50 mm under conditions of drawing out stroke and stopping time shown in Table 1 by using drawing out equipment.

TABLE 1

| | First Mold | | | Second Mold | Operation Conditions | | | |
|---|---|---|---|---|---|---|---|---|
| | Total Length of Mold L1 (mm) | Water Cooling Jacket L2 (mm) | Inner Diameter (mm) | Total Length of Mold L3 (mm) | Maintained Temperature (° C.) | Stroke (mm) | Stopping Time (sec.) | Cast Effects |
| Example 1 | 160 | 140 | 50 | 100 | 1400~1420 | 5 | 1~1.5 | ◎: Cast could be stably performed. |
| Example 2 | 160 | 140 | 50 | 100 | 1400~1420 | 10 | 3~5 | ◎: Cast could be stably performed. |
| Example 3 | 160 | 140 | 70 | 100 | 1400~1420 | 5 | 1~1.5 | ◎: Cast could be stably performed. |
| Example 4 | 100 | 80 | 50 | 100 | 1400~1420 | 5 | 10~15 | ○: Deformation slightly occurred. |
| Example 5 | 180 | 100 | 50 | 100 | 1400~1420 | 5 | 5~8 | ○: Minute cracks were generated. |
| Comparative Example 1 | 300 | 280 | 50 | Not Provided | 1400~1420 | 5~10 | 5~10 | X: Fracture occurred at 2 m. |
| Comparative Example 2 | 300 | 280 | 50 | 100 | 1400~1420 | 5 | 3~5 | X: Drawing out could not stably performed. |
| Comparative Example 3 | 160 | 140 | 50 | 100 | 1400~1420 | 3 | 0.8~1 | X: Drawing out could not stably performed. |
| Comparative Example 4 | 160 | 140 | 50 | 100 | 1400~1420 | 15 | 5~8 | X: Drawing out could not stably performed. |

TABLE 2

| | wt. % | | | | | | | |
|---|---|---|---|---|---|---|---|---|
| | C | Si | Mn | P | S | Cr | Ni | Fe |
| Example 1 | 2.36 | 2.02 | 0.44 | 0.027 | 0.009 | 0.028 | 0.97 | Balance |
| Example 2 | 2.3 | 2.0 | 0.4 | 0.02 | 0.01 | 0.03 | 1.0 | Balance |
| Example 3 | 2.4 | 1.94 | 0.45 | 0.035 | 0.007 | 0.038 | 0.48 | Balance |
| Example 4 | 2.32 | 1.96 | 0.52 | 0.035 | 0.001 | 0.036 | 0.98 | Balance |
| Example 5 | 2.32 | 1.96 | 0.52 | 0.035 | 0.001 | 0.036 | 0.98 | Balance |
| Comparative Example 1 | 2.38 | 1.97 | 0.48 | 0.026 | 0.009 | 0.027 | 0.97 | Balance |
| Comparative Example 2 | 2.34 | 2.04 | 0.45 | 0.025 | 0.008 | 0.026 | 1.02 | Balance |
| Comparative Example 3 | 2.37 | 1.97 | 0.57 | 0.03 | 0.001 | 0.022 | 1.05 | Balance |
| Comparative Example 4 | 2.35 | 1.99 | 0.56 | 0.03 | 0.001 | 0.021 | 0.98 | Balance |

Test Results

Figure 2:
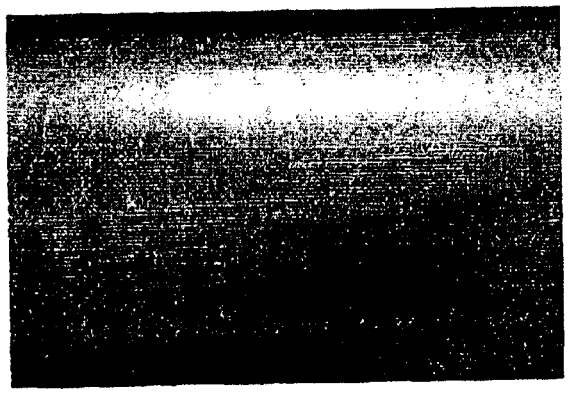
FIG. 2 is a photograph showing a side elevation view of a cast piece produced in Example 1.
Figure 3:
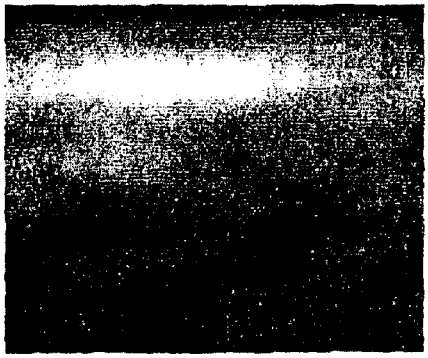
FIG. 3 is a photograph showing a side elevation view of a cast piece produced in Example 3.

In the horizontal continuous casting processes of Examples 1 to 3, the cast pieces could be stably drawn out and sound cast pieces could be obtained. In addition, in Examples 1 and 3, defects such as cracks did not occur, even if the stopping time was shortened to 1 second. FIGS. 2 and 3 are photographs showing each casting surface of the cast pieces of Examples 1 and 3, respectively, and it was verified that most oscillation marks were not tilted and the continuous casting processes were stably carried out. In Example 4, the cast piece could be drawn out; however, it was slightly deformed by cooling in the second mold because of high temperatures. In Example 5, a large temperature difference occurred between the top side and the bottom side of the cast piece, and oscillation marks tended to tilt, and there was a case in which minute cracks, although within the range of allowable quality, were generated on the upper surface thereof.

Here, the term "oscillation mark" refers to a striped pattern formed on the casting surface by intermittently drawing out, in which discontinuous interface formed by transferring and stopping of the solidified interface due to drawing out appears at a pitch which depends on the drawing out stroke, and it corresponds to contraction caused by solidification of the molten metal or cold shuts in general cast products. In the horizontal continuous casting process, a temperature difference easily occurs between the top side and the bottom side of a cast piece, and when the temperature difference is small, the oscillation marks are formed nearly perpendicularly, that is, in a direction which is at a right angle to a drawing out direction; in contrast, when the temperature difference is large, the oscillation marks are tilted toward the drawing out direction since the temperature of the top side is easily higher than that of the bottom side.

In order to obtain material which can be stably drawn out and which does not have structural differences between the top and the bottom, it is necessary that the temperature difference between the top and the bottom be as small as possible, and therefore, it is desirable that the oscillation marks be formed vertically. In addition, in the horizontal continuous casting process, it is desirable that the solidified shell smoothly move by drawing out; however, there are cases in which the solidified shell is torn off by drawing out when the solidified shell is thin. In these cases, oscillation marks are not formed at a pitch which depends on the drawing out stroke, and the pitch of the oscillation marks is uneven. That is, it is shown that sound continuous casting is carried out if the oscillation marks are formed nearly perpendicularly at an even pitch which depends on the drawing out stroke.

Figure 4:
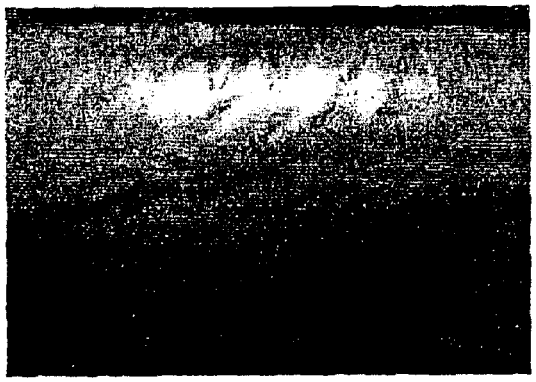
FIG. 4 is a photograph showing a side elevation view of a cast piece produced in Comparative Example 2.
Figure 5:
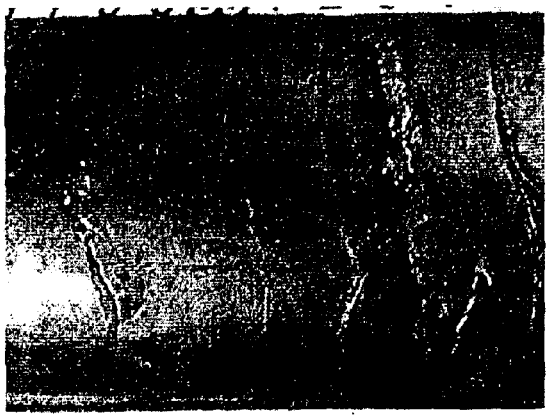
FIG. 5 is a photograph showing a top plan view of a cast piece produced in Comparative Example 2.

In contrast, in Comparative Example 1, cracks occurred on the top of the cast piece at an initial step which was discharged from the first mold. The cracking did not improve and unstable casting continued, even if the stopping time was lengthened to 10 seconds in order to prevent the cracking, and consequently, fractures were caused in the mold when the cast piece was cast 2 m. It was supposed that the solidifying initiation position reached the fire-resistance wall of the tundish and drawing out resistance was increased, and the fractures were thereby caused. In Comparative Example 2, since the bottom of the cast piece was easily solidified, the oscillation marks were greatly tilted, as shown in FIG. 4. This tilt was more remarkable because the stopping time was short. In addition, the cracks were generated on the top surface of the cast piece, as shown in FIG. 5, and the danger of breakout was confirmed.

Figure 6:
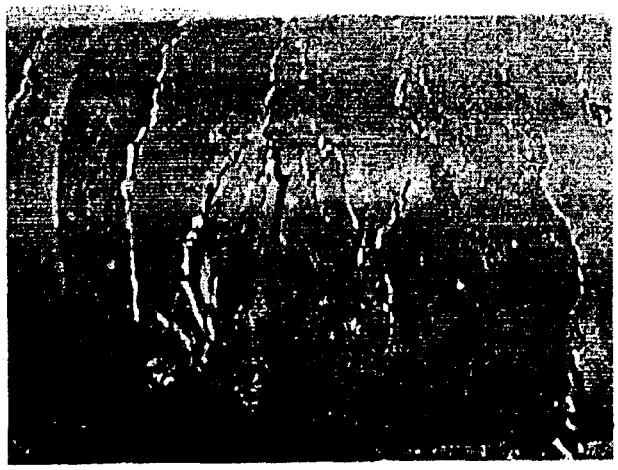
FIG. 6 is a photograph showing a side elevation view of a cast piece produced in Comparative Example 4.

In Comparative Example 3, the drawing out stroke was not stabilized at 3 mm by play of drawing out equipment. In addition, load on a driving system of the drawing out equipment was large since an intermittent operation of drawing out and stopping was frequently carried out. The quality of the cast piece was equal to that of Example 2. In Comparative Example 4, variability of oscillation marks was large and pitch thereof was uneven, as shown in FIG. 6, and crack occurred on the surface and drawing out of the cast piece was unstable.

(2) Second Embodiment

In the following, a billet for thixocasting processes according to the present invention will be explained in detail by specific embodiments.

Figure 7:
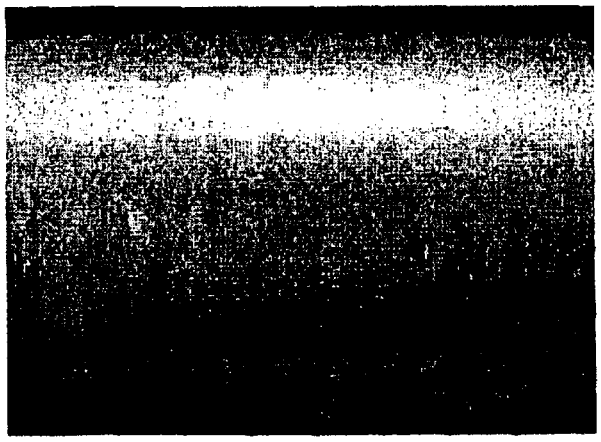
FIG. 7 is a photograph showing the appearance of a billet produced in Example 6.
Figure 8:
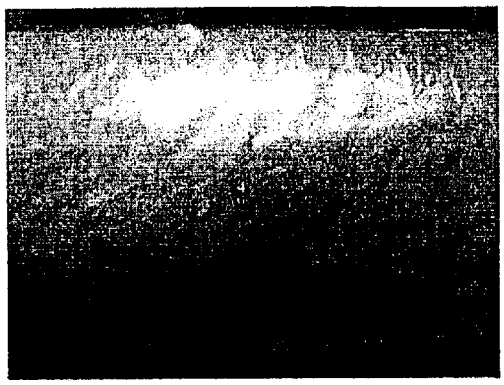
FIG. 8 is a photograph showing the appearance of a billet produced in Comparative Example 5.

Lengths L1 and L3 of inside walls of a first mold 10 and a second mold 20, length L2 of a water-cooling jacket for the first mold 10, which are shown in FIG. 1, and inner diameter of the first mold, were set to be values shown in Table 3, and continuous casting equipment for use in Examples 6 to 9 and Comparative Examples 5 to 8 were thereby produced. Additionally, each hypo-eutectic cast iron having components shown in Table 4 was prepared, and the hypo-eutectic cast iron was maintained in a molten metal state at 1400 to 1420° C. in each tundish to which the above continuous casting equipment for Examples 6 to 9 and Comparative Examples 5 to 8 were connected, respectively. Then, in the continuous casting equipment, a continuous casting test was carried out, which horizontally draws out cast pieces discharged from a second mold having an inner diameter of 50 mm under conditions of drawing out stroke and stopping time shown in Table 3 by using drawing out equipment. Then, billets for a half-melted molding of Examples 6 to 9 and Comparative Examples 5 to 8 were produced by cutting the cast pieces to 50 mm lengths. A photograph of the appearance of a billet of Example 6 is shown in FIG. 7, and a photograph of the appearance of a billet of Comparative Example 5 is shown in FIG. 8.

TABLE 3

| | First Mold | | | Second Mold | Operation Conditions | | |
|---|---|---|---|---|---|---|---|
| | Total Length of Mold L1 (mm) | Water Cooling Jacket L2 (mm) | Inner Diameter (mm) | Total Length of Mold L3 (mm) | Maintained Temperature (° C.) | Stroke (mm) | Stopping Time (sec.) |
| Example 6 | 160 | 140 | 50 | 100 | 1400~1420 | 5 | 1~1.5 |
| Example 7 | 180 | 160 | 50 | 100 | 1400~1420 | 5 | 5~8 |
| Example 8 | 160 | 140 | 50 | 100 | 1400~1420 | 10 | 3~5 |
| Example 9 | 180 | 160 | 50 | 100 | 1400~1420 | 10 | 5~8 |
| Comparative Example 5 | 300 | 280 | 50 | 100 | 1400~1420 | 5 | 3~5 |
| Comparative | 180 | 160 | 50 | 100 | 1400~1420 | 20 | 20~25 |

TABLE 3-continued

| | First Mold | | | Second Mold | Operation Conditions | | |
|---|---|---|---|---|---|---|---|
| | | Water | | | | | |
| | Total Length of Mold L1 (mm) | Cooling Jacket L2 (mm) | Inner Diameter (mm) | Total Length of Mold L3 (mm) | Maintained Temperature (° C.) | Stroke (mm) | Stopping Time (sec.) |
| Example 6 | | | | | | | |
| Comparative Example 7 | 300 | 280 | 50 | 100 | 1400~1420 | 20 | 15~20 |
| Comparative Example 8 | 180 | 160 | 50 | 100 | 1400~1420 | 30 | 30~35 |

TABLE 4

| | wt. % | | | | | | | |
|---|---|---|---|---|---|---|---|---|
| | C | Si | Mn | P | S | Cr | Ni | Fe |
| Examples 6 to 9 and Comparative Examples 5 to 8 | 2.35 | 2.0 | 0.6 | <0.04 | <0.04 | <0.04 | 1.0 | Balance |

Billets having the same size and composition in which intervals of the oscillation marks and the maximum tilt angle were different were produced in the same manner as in the continuous casting test described in the above first embodiment, and were heated by high frequency induction heating equipment until the interior temperature of the billets reached 1230° C. which is in the half-melting temperature region.

Figure 9:
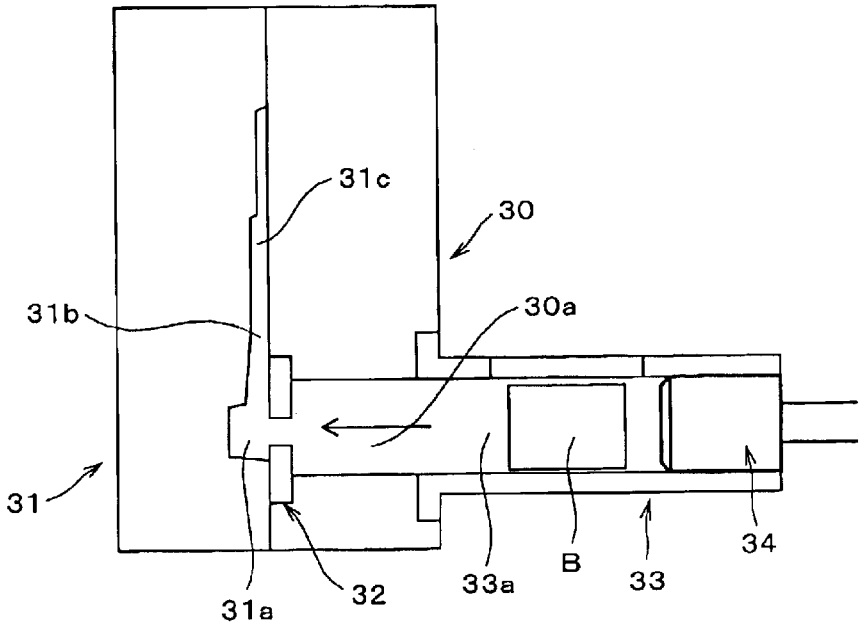
FIG. 9 is a sectional side elevation view of injection molding equipment used in Examples of the present invention.

FIG. 9 shows injection molding equipment to produce a product from a billet by using thixocasting processes. The injection molding equipment comprises: a fixed side die 30; a mobile side die 31 which can be removed in a passing direction of billet B (arrow direction) against the fixed side die 30; an oxide film trap gate 32 in a cylindrical shape which is located between the fixed side die 30 and the mobile side die 31; a cylindrical sleeve 33 contacted to a side which is not provided with the mobile side die 31 of the fixed side die 30; and a plunger 34 provided inside the sleeve 33 which can be moved in the passing direction of billet B. The fixed side die 30 forms a void 30*a* for passing the billet. The mobile side die 31 forms a recess for trapping oxide film 31*a*, a runner 31*b* and a product forming portion 31*c*. The sleeve 33 forms a void 33*a* which connects to the void 30*a* for passing the billet.

The present inventors handled the billet produced as described above by a pallet which is not shown, and carried out an injection molding by the following process. The billet was injected into the void 33*a* of the sleeve 33 shown in FIG. 9, was pressed by the plunger 34, and was pushed from the void 33*a* to the product forming portion 31*c* through the void for passing billet 30*a*, the recess for trapping oxide film 31*a*, and the runner 31*b*. In the injection molding, a layer flow filling condition was set to be an inner diameter of the sleeve 33 and an outer diameter of an injection chip of 55 mm, and an injection speed of 0.1 m/sec.

Then, the degree of deformation of the billet in injection into the void 33*a* was judged by visual observation, and permeation of oxide film to the inside of the billet due to deformation of the billet in the void 33*a* was judged by visual observation of the surface of the products. The results are shown in Table 5 with the intervals of oscillation marks and the maximum tilt angles. If the billet injected into the void 33*a* holds cylindrical form, the oxide film is caught by the oxide film trap gate 32 and the recess for trapping oxide film 31*a* in FIG. 9, so as to prevent the oxide film from permeating to the inside of the billet. However, when the billet deforms in the void 33*a*, the above capture becomes imperfect depending on the degree of deformation, and the oxide film permeated to the inside of the billet and is mixed in the products.

TABLE 5

| | Oscillation Marks | | Degree of Deformation of | Permeation |
|---|---|---|---|---|
| | Intervals mm | Tilt Angles ° | Billet in Entering into Sleeve | to the Inside of Billet |
| Example 6 | 5 | 15 | Nothing | No Permeated |
| Example 7 | 5 | 30 | Small | No Permeated |
| Example 8 | 10 | 10 | Nothing | No Permeated |
| Example 9 | 10 | 45 | Middle | No Permeated |
| Comparative Example 5 | 5 | 60 | Large | Permeated |
| Comparative Example 6 | 20 | 30 | Large | Permeated |
| Comparative Example 7 | 20 | 60 | Large | Permeated |
| Comparative Example 8 | 30 | 30 | Large | Permeated |

Test Results

Figure 10:
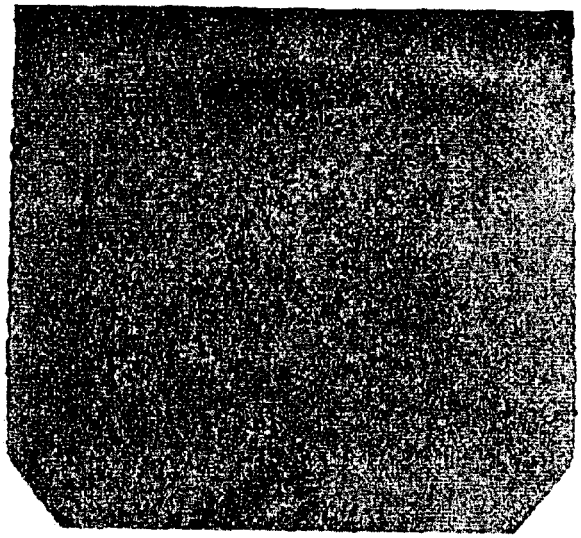
FIG. 10 is a photograph showing a surface of a product produced by a billet of Example 6.

In Examples 6 to 9, the billet could yield good form maintaining property, and therefore, the oxide film did not permeate to the inside of the billet. In particular, in Examples 6 and 8, the billet could maintain form to a high degree, since the interval of the oscillation marks and the maximum tilt angle were both small. In order to confirm the above results, a photograph of the surface of a product produced by the billet of Example 6 is shown in FIG. 10. As is apparent from this figure, contamination of the oxide film in the product was not observed.

Figure 11:
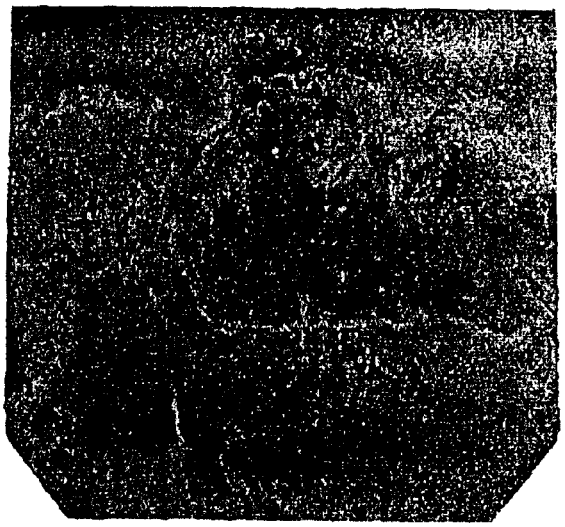
FIG. 11 is a photograph showing a surface of a product produced by a billet of Comparative Example 5.

In contrast, in Comparative Examples 5 to 8, the billet could not yield good form maintaining property, and therefore, the oxide film permeated to the inside of the billet. In order to confirm the above results, a photograph of the surface of a product produced by the billet of Comparative Example 5 is shown in FIG. 11. As is apparent from this figure, contamination of the oxide film in the product was clearly observed.

What is claimed is:

1. A horizontal continuous casting process comprising: filling molten metal into a first mold; cooling the molten mold to form a cast piece while passing the cast piece to a second mold which is movable so as to press the cast piece; and intermittently drawing out the cast piece discharged from the second mold at a specific drawing out stroke, wherein the length of an inner wall in the first mold is 100 to 180 mm and the drawing out stroke is 5 to 10 mm.

2. A horizontal continuous casting process in accordance with claim 1, wherein an inner wall of the first mold is made of graphite as a primary component and an inner wall of the second mold is made of a Cu alloy as a primary component.

3. A billet continuously cast by intermittently drawing out, the intermittently drawing being performed by drawing and stopping the billet alternately, the drawing being performed by drawing out and sliding the billet with respect to a mold, the stopping being performed by stopping the billet, the billet having oscillation marks, wherein an interval of the oscillation marks is 10 mm or less and having a maximum tilt angle of the oscillation marks of 45° or less relative to a cross section which is perpendicular to a drawing out direction.

4. A billet in accordance with claim 3, wherein the maximum tilt angle is 15° or less.

5. A thixocasting process comprising:

pressure-casting a billet by continuously casting the billet by intermittently drawing the billet out, the intermittently drawing being performed by drawing and stopping the billet alternately, the drawing being performed by drawing out and sliding the billet with respect to a mold, the stopping being performed by stopping the billet, the billet having an interval of oscillation marks of 10 mm or less and having a maximum tilt angle of the oscillation marks of 450° or less relative to a cross section which is perpendicular to a drawing out direction in accordance with claim 1.

6. The thixocasting process of claim 5, wherein the maximum tilt angle is 15° or less.

7. A thixocasting process in accordance with claim 6, wherein a solid concentration of the billet is 30 to 50%.

8. A thixocasting process in accordance with claim 5, wherein a solid concentration of the billet is 30 to 50%.

* * * * *